United States Patent [19]

Gernhardt et al.

[11] 4,073,628

[45] Feb. 14, 1978

[54] CONTROL SYSTEM FOR APPARATUS TO GASIFY FINE-GRAIN FUELS IN A REACTOR

[75] Inventors: Paul Gernhardt, Bochum; Wolfgang Grams, Wanne-Eickel; Wilhelm Danguillier; Siegfried Pohl, both of Bochum, all of Germany

[73] Assignee: Dr. C. Otto & Comp. G.m.b.H., Bochum, Germany

[21] Appl. No.: 746,245

[22] Filed: Dec. 1, 1976

[30] Foreign Application Priority Data

Dec. 18, 1975 Germany ..... 2556957

[51] Int. Cl.[2] ..... B01J 3/00

[52] U.S. Cl. ..... 48/62 R; 48/86 R; 48/DIG. 2; 48/DIG. 4; 141/47; 141/67; 177/70; 214/18.2; 222/58; 266/82

[58] Field of Search ..... 48/62 R, 73, 76, 77, 48/83, 63, 87, 86 R, DIG. 4, DIG. 2; 222/58; 214/18.2, 17 CA; 177/70, 98; 141/47, 49, 67; 302/53, 55, 59, ; 266/82

[56] References Cited

U.S. PATENT DOCUMENTS

| | | | |
|---|---|---|---|
| 2,984,387 | 5/1961 | White | 222/58 |
| 3,307,646 | 3/1967 | Hage | 177/98 |
| 3,362,490 | 1/1968 | Maxwell | 177/70 |
| 3,689,045 | 9/1972 | Coulter et al. | 266/82 |
| 3,820,768 | 6/1974 | Sieckman et al. | 266/82 |
| 3,889,848 | 6/1975 | Ricciardi et al. | 222/58 |

*Primary Examiner*—Robert L. Lindsay, Jr
*Assistant Examiner*—George C. Yeung
*Attorney, Agent, or Firm*—Thomas H. Murray

[57] ABSTRACT

Fine-grain fuel is delivered from pressure vessels with a vehicle gas as a fluidized flow into a reactor for gasification at an elevated pressure. A gaseous gasification agent is also fed into the reactor. A control system for the fine-grain fuel and gasification agent includes detectors to provide an electrical signal which varies during feeding of fuel from the pressure vessels into the reactor. Controllers produce a fuel rate control signal corresponding to a comparison between the electrical signal from the detectors and a predetermined reference value corresponding to the desired fuel supply rate. Control valves respond to the fuel rate control signal to adjust the supply of vehicle gas to transfer fuel from the pressure vessels into the reactor. When a plurality of pressure vessels is used, then separate detectors, controllers and control valves form part of a control system which further includes computing means to provide a summation signal corresponding to the output signals from the various detectors. The summation signal is used by the various controllers for adjusting the control valves associated with each pressure vessel. A further controller produces a gasification agent control signal in response to a comparison between the summation signal and a predetermined reference value corresponding to a desired supply rate of gasification agent into the reactor. A control valve is operated in response to the gasification agent control signal. The control system further includes a gas analyzer responsive to the gaseous product from the reactor to monitor the supply of gasification agent into the reactor and adjust the supply thereof to the reactor.

8 Claims, 3 Drawing Figures

CONTROL SYSTEM FOR APPARATUS TO GASIFY FINE-GRAIN FUELS IN A REACTOR

BACKGROUND OF THE INVENTION

This invention relates to a control system for gasifying fine-grain fuels in a reactor at elevated pressures, and more particularly, to a control system to adjust the supply of such fine-grain fuel delivered as a fluidized flow from a vessel with a vehicle gas into the reactor while a gasification agent is also introduced into the reactor.

Reliable operation of a high-temperature gasifier and more particularly, a high-temperature pressure gasifier, is achieved essentially by accurate metering of the supply of fuel for gasifying and the necessary gasification agents, typically oxygen and steam.

The older types of high-temperature gasifiers operate substantially at atmospheric pressure on the gas side and have a throughput capacity of about 10 tons per hour of fuel. The fuel is coal usually in fine-grain form. An output control for such a gasifier is not used nor is an automatic control used to meter the supply of fuel or each gasification agent. The operation of such a gasifier is based on the concept that the devices for feeding the charge of material into the reactor chamber of the gasifier operate within adequate limits of consistency; consequently, there is no need for accurate determination of the charge of material introduced into the reaction chamber per unit of time, nor for the continuous control of the charge of material so as to maintain some constant value. When the actual values to the charges of material are found to differ from performance requirements, then the devices for feeding the charge of materials into the reaction chamber must be adjusted until the required performance or throughput has been reached. Such a type of control is an open-loop control.

Similar considerations apply to metering the additions of gasifying agents with the fuel. An appropriate quantity of gasifying agent is supplied to the charge of material per unit of time before and/or upon entry as a mixture into the reaction chamber. This depends upon the construction of parts and a particular pressure difference between the gasifying agent feed lines and the reaction chamber. Any corrections or adjustments which become necessary must be made externally in order that the required quantity of gasifying agent is added to the charge of material for introduction into the reaction chamber.

A more modern-type of high-temperature gasifier is operated at reaction chamber pressures of 20 bar or more. As the pressure increases in the reaction chamber, gasifier performance for a given reactor cross section, multiplies. Thus, where high gasification reactor performances are required, only high-temperature and high pressure gasifiers are used.

It is impossible to make control adjustments based on an open-loop system as hereinbefore described for the modern-type of high-temperature and high pressure gasifier because of the greatly-increased performance for a given cross section of reactor and the large quantities of fuel and gasification agent which are introduced into the gasifier per unit of time. This is because the response time of such an open-loop control is excessive even though an immediate action may be taken by operating personnel in charge of controlling the gasification plant. If an excessive amount of gasifying agent, i.e., the supply of oxygen, is fed into a gasifier for as little as a few seconds, there is an immediate and excessive temperature overshoot. Conversely, a deficient addition of gasifying agent causes an immediate temperature drop. In both instances, the improper supply of gasifying agent to the gasifier produces an unacceptable variation in the composition of the end-product gas from the gasifier.

A very effective control system for accurate operation and a very short response time is needed to alleviate these disadvantages. An important consideration in pressure gasifying systems is the ability to control the quantity of gas produced per unit of time from a low value up to a maxium value. The quantity of fine-grain fuel to be fed into the gasifier varies in accordance with the output requirements from the gasifier. To gasify a given quantity of fine-grain fuel per unit of time requires a given input volume of gasifying agent.

SUMMARY OF THE INVENTION

It is an object of the present invention to provide a control system establishing a predetermined relationship which is automatically maintained between an input volume of gasifying agent and a supply rate of fine-grain fuel to be gasified.

It is another object of the present invention to provide a control system for a gasification plant adapted for continuous operation while the quantity of a gaseous output per unit of time is adjustable.

It is a further object of the present invention to provide a control system adapted to meet the existing requirements and wherein one or more pairs of pressure vessels from which fuel is taken seritim by means of a vehicle gas and whereafter the pressure vessels are refilled with fine-grain fuel.

In accordance with the present invention, there is provided an apparatus including a reactor for gasifying fine-grain fuel at an elevated pressure, pressure vessels containing fine-grain fuel while fluidized with the vehicle gas for delivery into the reactor, and means for supplying a gasification agent into the reactor, a control system for the introduction of the fluidized fine-grain fuel and the gasification agent which includes the combination of load cells supporting the vessels in a manner for response to the weight of fine-grain fuel therein, detector means to provide an electrical signal which varies in response to measurements by the load cells at predetermined time intervals during the feeding of fine-grain fuel from the vessels into the reactor, controller means producing a fuel rate control signal in response to a comparison between the electrical signal from the detector means and a predetermined reference value corresponding to a desired fuel supply rate, and control means responsive to the fuel rate control signal to adjust the supply of vehicle gas to transfer fuel from the pressure vessels for varying the rate of introduction of fluidized fine-grain fuel into the reactor.

Thus, according to the present invention, load cells are provided to determine the content of fine-grain fuel in the pressure vessels together with detector means which provide electrical signals corresponding to the output of the load cells at predetermined time intervals so that, in practice, the quantity by weight of fine-grain fuel removed from an individual pressure vessel per unit of time can be determined. The data provided by these parts relative to the quantity of fine-grain fuel removed from the pressure vessels and supplied to the gasifier reactor per unit of time is fed to a controller which processes the data and supplies a control signal to a final control member which controls the quantity of the vehicle gas employed to transfer the fine-grain fuel from the pressure vessel to the gasifier. The controller adjusts the quantity of fuel per unit of time in accordance with a predetermined reference value.

The controller also acts on a final control element used to adjust the quantity of gasifying agent which is fed into the gasifier reactor. This controller operates in response to a set value versus actual value comparison in accordance with a set or reference value of the relationship between the quantity of the fuel supplied per unit of time and the quantity of gasifying agent supplied per unit of time. A corresponding control signal is used for operating a control element for corresponding adjustments to the supply of gasifying agent.

The pressure vessels from which the fine-grain fuel is taken cyclically have provisions whereby shortly before the emptying of each pressure vessel, discharge control valves are closed to that particular pressure vessel and discharging valves are open to the next pressure vessel in a discharge sequence for the use of the vessels. A changeover feature of this type for the discharge control valves can be controlled by the weight of the vessel from which the fine-grain fuel is discharged at a particular time. The changeover operation takes place when the weight of the vessel drops to a very low value. However, by detecting when the pressure which exists in the pressure vessel drops shortly before emptying, this pressure drop can be detected and used as a signal so that the changeover valves are operated when a predetermined very low pressure is reached.

When there is a plurality of pairs of pressure vessels, a computer is provided to assure an orderly fuel delivery operation to the gasifier reactor. Associated with each pair of pressure vessels is a device which measures or detects the load cell output valves at predetermined time intervals. Controllers, associated with each pair of pressure vessels, process the load cell output values provided by the load cells in regard to the quantity of solid fine-grain fuel removed from the pressure vessels and supplied to the gasifier reactor per unit of time. Final control elements are also associated with each pair of pressure vessels to adjust the quantity of vehicle gas employed to transfer the fine-grain fuel from the pressure vessels to the gasifier reactor.

The output signals from the discrete load cell devices associated with the pairs of pressure vessels are supplied to the computer to provide a summation signal which is delivered as an output signal to controllers for operation of final control members. The controllers adjust the quantity of fine-grain fuel introduced per unit of time into the gasifier reactor in accordance with a predetermined set value. The computer supplies another output signal to a controller which acts on other final control elements associated with the delivery of gasifying agents into the gasifier reactor.

A gas analyzer is employed to monitor the entire system by monitoring the input of gasifying agents in relation to the input of fine-grain fuel by the output of the controller. A signal amplifier delivers the signal from the gas analyzer to the controller to correct adjustments to the control elements for the gasifying agent to eliminate overshoots and undershoots.

These features and advantages of the present invention as well as others will be more fully understood when the following description is read in light of the accompanying drawings, in which.

The reactor for the gasification process may be of any well-known type, specifically, for example, a slag bath generator which includes a vessel with nozzles dispersed about the lower peripheral-portion of a vertical reactor vessel for injecting jet streams of a mixture of fine-grain coal and vehicle gas toward the bottom of the reactor shaft. The bottom of the generator is provided with an annular trough in which a layer of slag is maintained by a slag overflow arranged centrally within the reactor shaft to discharge slag as it is continuously formed. The jets of fuel and gasification agent from the nozzles are directed at an angle to the surface of the bath of slag so that the slag undergoes a circular motion with a net slag movement toward the overflow. A slag bath generator of this type is shown in copending application Ser. Nos. 684,112, now abandoned and 735,180, now U.S. Pat. No. 4,043,766, assigned to the same Assignee as the present invention. As disclosed in the former copending application, the slag bath generator is operated to gasify the coal at a temperature between 1500° C and 2200° C. At these temperatures slag occurs in liquid form. Under normal operating conditions, a pressure of 25 atmospheres is maintained in the reactor shaft. Other details concerning the gasification process for pulverulent or fine-grain ash containing coal used as a fuel as disclosed in this copending application are exemplary of the operation of a slag bath generator which is the preferred form of the reactor for control by the control system of the present invention.

Figure 1:
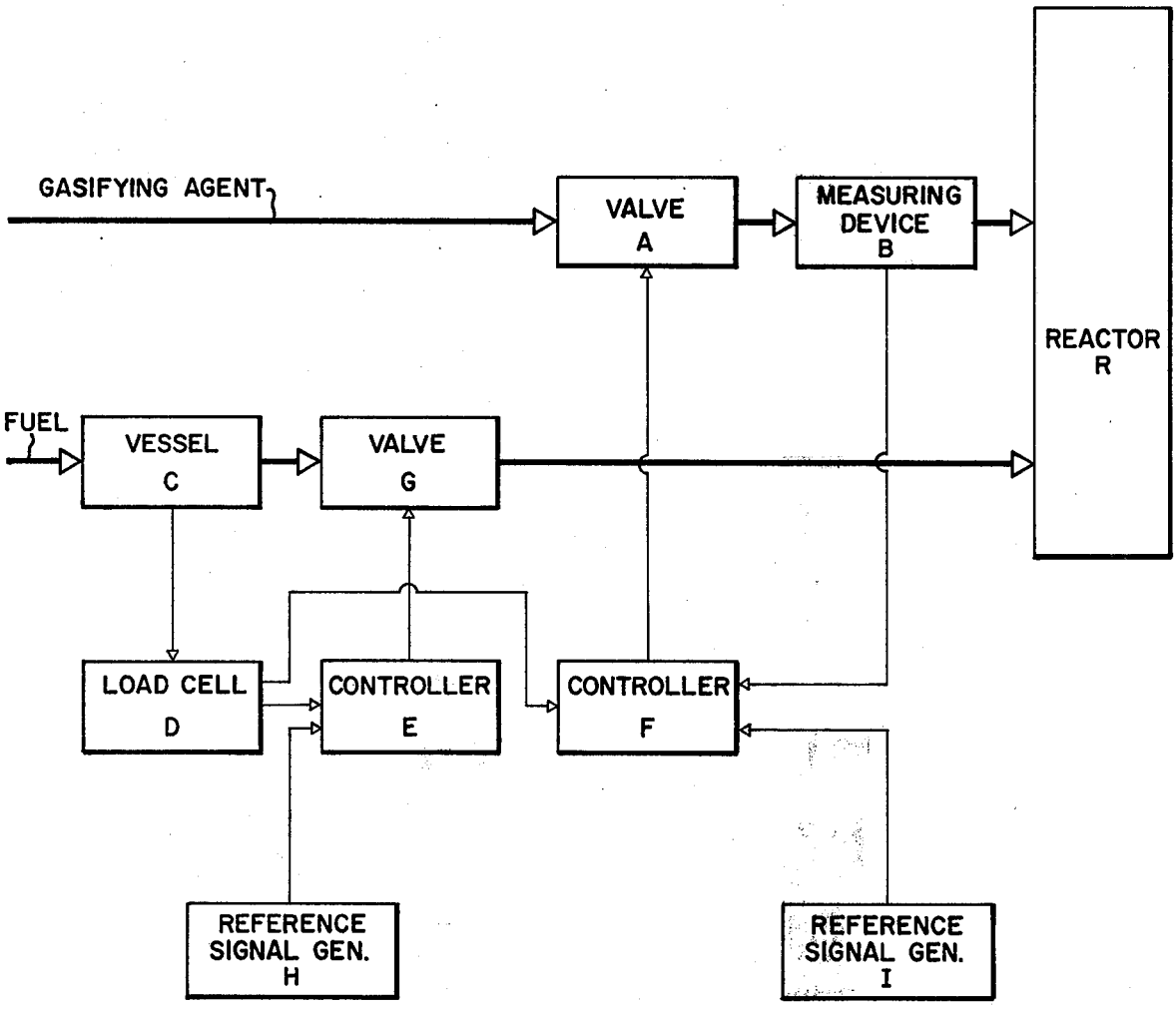
FIG. 1 is a schematic view of a control system for a gasifying apparatus which includes a pair of pressure vessels to supply fine-grain fuel to a reactor.

As illustrated by FIG. 1, a gasifying agent, such as oxygen and steam, is fed by a pipeline incorporating a final control element A such as a valve through a measuring device B such as a diaphragm into a reactor R which is in the form of a high-temperature and pressure gasifier. As pointed out previously, the gasifier operates at a pressure of 20 bar or greater. A pressure vessel C is supported by a weighing device D adapted for intermittent operation. The weighing device D is preferably in the form of load cells upon which the pressure vessel is supported. Controllers E and F receive output signals from the weighing device D. Final control elements G, such as valves, adjust the flow of a conveying or vehicle gas used to convey fine-grain fuel as a fluidized flow from the pressure vessel C into the gasifier. The fine-grain fuel is typically coal in finely-divided form. Controller E delivers a control signal for adjusting the control element G and controller F delivers a control signal for adjusting the control element A. The measured values by the weighing device D, i.e., the output signals thereof, are supplied to the two controllers E and F, controller E also receives a set value from a signal generator H such as a potentiometer or the like. The set value corresponds to the required gasifier performance. Controller F also receives a set value from a signal generator I such as a potentiometer or the like, which set value corresponds to the relationship between the quantity of fine-grain fuel to be supplied per unit of time and the gasification agent to be supplied per unit of time. The actual value of the gasifying agent introduced into the gasifier is measured by diaphragm B which delivers an output signal to controller F. Controller E, therefore, receives as a set value, a signal corresponding to the required fine-grain coal throughput and, therefore, the required gasifier performance or output. The actual value of the quantity of fine-grain coal flowing through the feed line to the gasifier is determined as a difference value once each timing interval through the agency of the intermittently-operated weighing device D. This actual value to the flow of fine-grain fuel is supplied as a signal to controller E for comparison with the set-value signal from signal generator H. The charge of fine-grain fuel, in terms of a quantity per unit of time, in the feed line to the gasifier is varied in an increasing or decreasing manner by the final control element G in accordance with the output signal from controller E. Control element G is associated with the pressure vessel and essentially comprises valves which provide a controlled flow of charging or vehicle gas at various places therein to provide a fluidized flow of fine-grain coal. The quantity of fine-grain coal conveyed while indirectly detected by the weighing device D, is proportional to the flow of conveying gas and, therefore, an accurate determination of the quantity of a charge of fine-grain coal per unit of time is possible.

The controller F receives a set-value signal denoting the relationship between the quantity of charge of fine-grain coal per unit of time and the quantity of gasifying agent per unit of time to be fed into the reactor. The command variable for the controller F is the charge quantity per unit of time as detected by weighing device D. The actual value of the throughput of gasifying agent is determined by diaphragm B and supplied as a corresponding signal to controller F for comparison with the set-value input thereto. The final control element A varies the delivery of gasifying agent to the gasifier in either increased or decreased quantities in accordance with the output signal from controller F.

Figure 2:
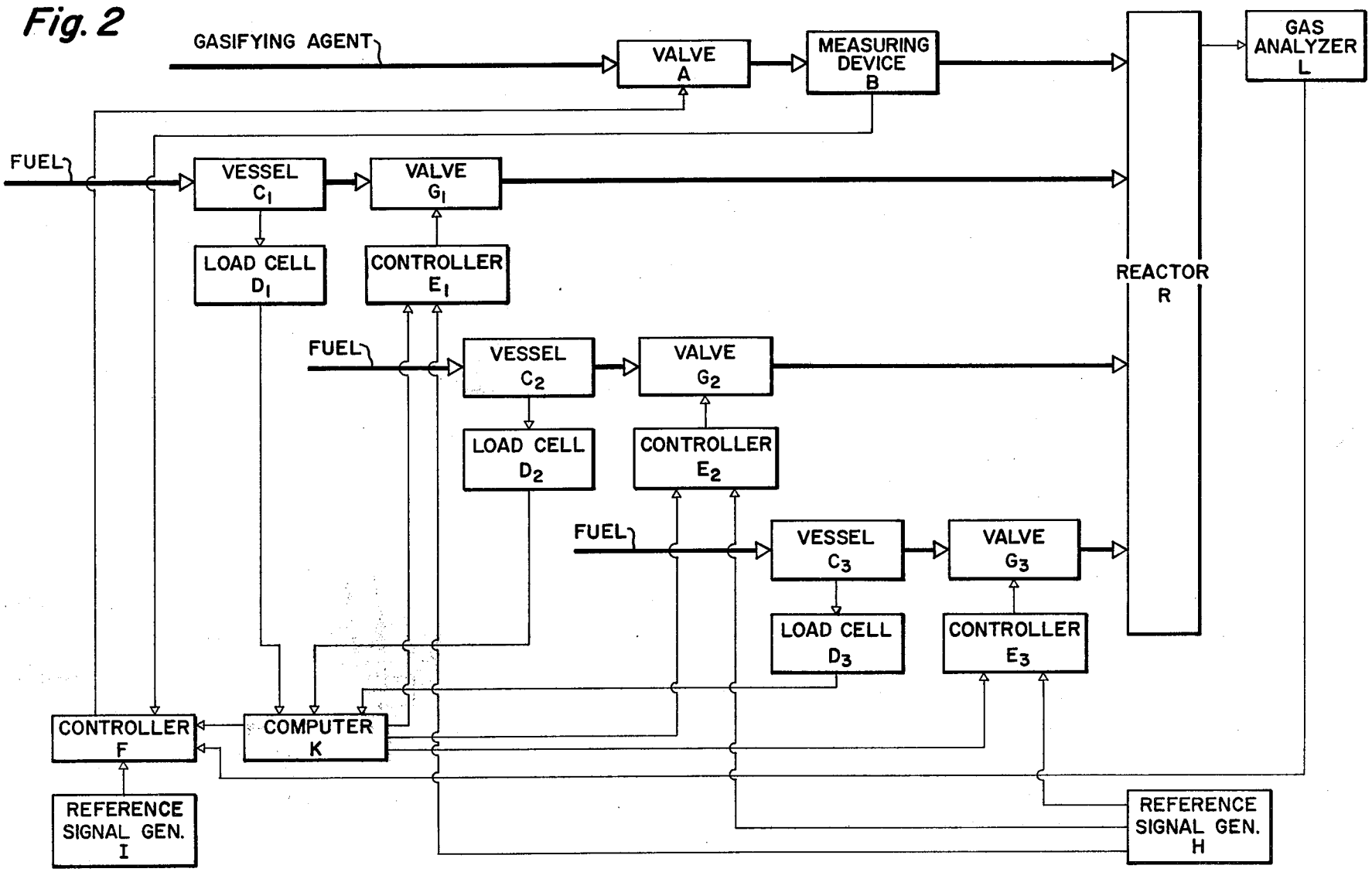
FIG. 2 is a schematic view of a control system wherein a number of pairs of pressure vessels is used to convey fine-grain fuel to a gasifier embodying additional features of the control system according to the present invention.

FIG. 2 is a schematic view of a control system suitable for use in a gasification plant where three pressure vessel systems C1, C2 and C3 are provided to convey a charge of fine-grain fuel into the gasification reactor R. The control system, in addition to the elements already described in regard to FIG. 1, includes a computer K or other form of summation device to form a signal corresponding to the total of the quantities of fine-grain fuel introduced by discrete pressure vessels C1-C3 during a cycle time. The computer provides an output signal to controllers E1, E2 and E3 and controller F. As in the control system of FIG. 1, the quantity of fine-grain fuel actually conveyed by the conveying conduits is the command variable for controlling the addition of gasifying agents. A feedback signal from a gas analyzer L is also fed to controller F. Consequently, should the relationship between the quantity of fine-grain fuel supplied per unit of time and quantity of gasifying agents supplied per unit of time fail to correspond to the set value supplied by signal generator I despite the metered addition of the gasifying agent, the analyzer L detects the discrepancy and supplies a signal to controller F whereby a corresponding adjustment is made by a control signal delivered to final control element A.

Figure 3:
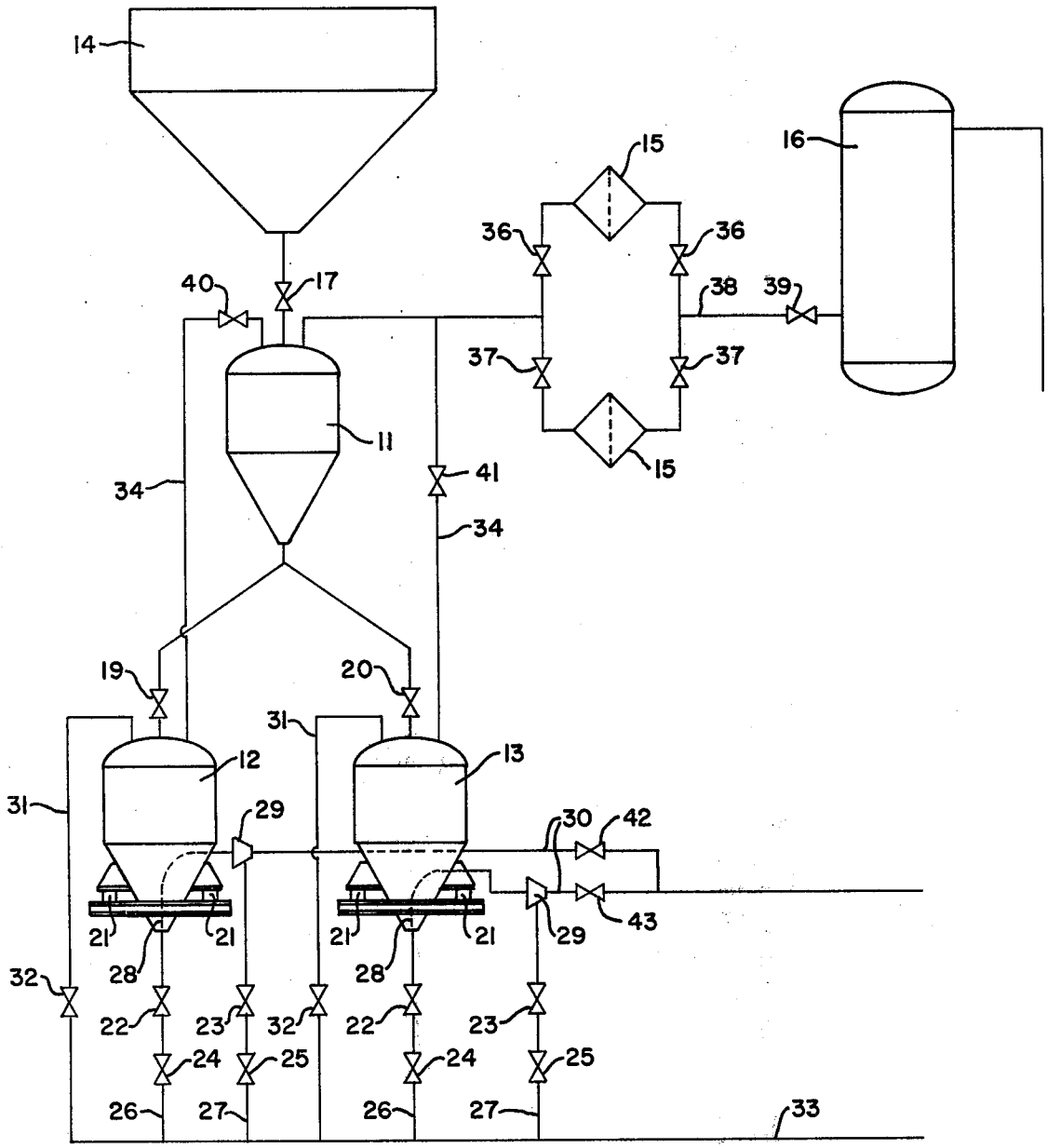
FIG. 3 illustrates the arrangement of parts for supplying fine-grain fuel wherein valves are controlled by the control system shown in FIGS. 1 or 2.

The control systems of either FIG. 1 or 2 may be employed for controlling the operation of a gasification reactor and as pointed out in regard to these systems, they are employed to control the feed of fine-grain fuel in the form of a fluidized flow for introduction into the gasification reactor. FIG. 3 illustrates an arrangement of apparatus for the delivery of fine-grain fuel as a fluidized flow into a gasification reactor, not shown. A supply bunker 14 includes a bottom discharge valve 17 through which fuel such as fine-grain coal is fed into a hopper 11 from which the fuel is either fed through valve 19 into pressure vessel 12 or through valve 20 into pressure vessel 13. A feed line 33 supplies conveying or vehicle gas which is conducted to the tops of pressure vessels 12 and 13 by lines 31. Lines 31 include shut-off valves 32. Vehicle gas from feed line 33 is also delivered by lines 26, each having a control valve 22 and a changeover valve 24, into the base portion of the pressure vessels 12 and 13.

The purpose of supplying vehicle gas through lines 31 to the tops of the pressure vessels is to maintain a relatively high pressure above the fine-grain fuel in the pressure vessels such that the fuel descends uniformly in the vessels. The fine-grain fuel in a fluidized form with vehicle gas is discharged from each pressure vessel through an outlet 28. Each outlet includes an injector 29 coupled to lines 30 which extend to a gasification reactor where the fluidized flow of fine-grain coal is injected through nozzles into the reactor. Lines 30 include valves 42 and 43 whereby the fluidized flow of fine-grain fuel can be terminated by operation of the valves. Vehicle gas from line 33 is delivered by lines 27 through changeover valves 25 and control valves 23 to the injectors 29 where the fine-grain fuel which is already in a partial fluidized form is fluidized to the desired extent with vehicle gas for delivery by lines 30 to the gasification reactor. The pressure vessels 12 and 13 are supported by legs upon load cells 21 which are, in turn, carried by framework of a platform for the gasification plant.

Lines 34 communicate with the top of hopper 11. One line 34 has a valve 40 therein extending to the top of pressure vessel 12. The other line 34 has a valve 41 therein extending to the top of pressure vessel 13. A line 38 extends from the top of hopper 11 to an expansion vessel 16. Pairs of valves 36 and 37 are arranged in branched portions of line 38. In each branch portion of line 38 between the pair of valves 36 and between the pair of valves 37 there is arranged a filter 15.

In the system shown in FIG. 3, let it be assumed that the delivery of fine-grain coal from pressure vessel 13 has just terminated because of a depletion of the coal content in the vessel. The pressures in pressure vessel 13 and hopper 11 are in the state of equalization by the operation of valve 41. After valve 20 has been opened, fine-grain coal starts to flow into pressure vessel 13. Valves 17, 19, 39 and 40 are closed and valves 20 and 41 are open. Valves 24, 25 and 32 associated with pressure vessel 13 are in a closed state so that pressure vessel 13 is isolated from the supply of vehicle gas. Valve 43 is also closed.

Valves 22-25 and 32 in the lines extending from pressure vessel 12 are open and, therefor, fine-grain fuel is conveyed from pressure vessel 12 through line 30 and thence through valve 42 which is open into the gasifier until substantially all the fine-grain fuel has been removed from pressure vessel 12. Once the pressure vessel 12 has been emptied, the control system of the present invention includes a detector which is responsive to the weight indication measured by load cells 21 or to a reduction of pressure occurring upon removal of the fuel to bring about an operation for changeover whereby the pressure vessel 13 is now employed to supply the fine-grain fuel to the gasification reactor. It being understood, of course, that before this change-over in operation occurs, pressure vessel 13 will have been filled with a charge of fine-grain coal from hopper 11.

A further operative state of the system shown in FIG. 3 includes closing valves 17, 19, 20, 40 and 41 while valves 36, 39 are open. The pressure in hopper 11 is relieved by way of line 38. When the pressure in hopper 11 reaches atmospheric pressure, valve 17 is opened and the hopper or lock 11 can be filled with fine-grain fuel passing from hopper 14. In this state of operation, it will be understood, of course, that the valves associated with the two pressure vessels 12 and 13 have been changed around. The valves 24, 25, 32, 42 associated with pressure vessel 12 are in the closed state. The valves 24, 25, 32 associated with the pressure vessel 13 are open as is the valve 43 in line 30 from the pressure vessel 13 to the gasification reactor. The valves 22 and 23 associated with pressure vessels 12 and 13 correspond to the final control element G of the control system of the present invention as shown in FIG. 1. It is to be understood, of course, that the control elements for the supply of gasification agent, i.e., oxygen and/or steam, have been omitted from FIG. 3 since they are deemed to be adequately disclosed to those skilled in the art in regard to the description in regard to FIGS. 1 and 2.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In combination with an apparatus including a slag bath generator having a reactor for gasifying fine-grain fuel at an elevated pressure while maintaining a bath of liquid slag therein, a pressure vessel containing fine-grain fuel while fluidized with a vehicle gas for delivery into said reactor, and means for supplying a gasification agent into said reactor, a control system for controlling the introduction of the fluidized fine-grain fuel and the said gasification agent, said control system including the combination of:

load detecting means supporting said vessel in a manner for response to the weight of fine-grain fuel therein, detector means to provide an electrical signal which varies in response to measurements by said load detecting means at predetermined time intervals during the feeding of fine-grain fuel from said pressure vessel into said reactor, controller means producing the fuel rate control signal in response to a comparison between the electrical signal from said detector means and a predetermined reference value corresponding to a desired fuel supply ratio, and control means responsive to said fuel rate control signal to adjust the supply of vehicle gas used for fluidized withdrawal and transfer of fuel from said pressure vessel for varying the rate of introduction of fluidized fine-grain fuel into said reactor.

2. The control system according to claim 1 wherein said load detecting means includes load cells.

3. The control system according to claim 2 wherein said controller means includes first and second controllers, said first controller producing said fuel rate control signal, said second controller producing a gasification agent control signal in response to a comparison relationship between the electrical signal from said detector means and a predetermined reference value corresponding to desired supply rate of gasification agent into said reactor, said control system further including gas control means responsive to said gasification agent control signal to adjust the delivery of said gasification agent into said reactor.

4. The control system according to claim 3 further including gas analyzer means responsive to the gaseous product from said reactor for monitoring the supply of said gasification agent into said reactor, and amplifier means responsive to said gas analyzer means to adjust the supply of gasification agent controlled by said gas control means in response to said gasification agent control signal.

5. The control system according to claim 4 wherein said amplifier means delivers an output signal to said second controller.

6. The control system according to claim 1 wherein said pressure vessel includes a plurality of pressure vessels, and wherein each of said plurality of pressure vessels is supported by a load cell for response to the weight of fine-grain fuel therein, said detector means including a discrete detector for each such load cell, said control system further including computing means responsive to the electrical signals from said discrete detectors to produce a summation signal corresponding to the quantity of fine-grain fuel supplied per unit of time from said plurality of pressure vessels to said reactor, said summation signal defining the electrical signal fed to said controller means to produce the fuel rate control signal.

7. The control system according to claim 6 wherein said controller means includes discrete controllers and said control means includes discrete controls responsive to said summation signal to adjust the supply of vehicle gas to transfer fuel from associated individual ones of said plurality of pressure vessels for varying the rate of introduction of fluidized fine-grain fuel into said reactor in accordance with comparison with the predetermined reference value corresponding to a desired fuel supply rate.

8. The control system according to claim 7 wherein said controller means further includes a controller producing a gasification agent control signal in response to a comparison relationship between said summation signal and a predetermined reference value corresponding to a desired supply rate for gasification agent into said reactor, said control system further including gas control means responsive to said gasification agent control signal to adjust the delivery of said gasification agent into said reactor.

* * * * *